US009617853B2

(12) United States Patent
Kawai et al.

(10) Patent No.: US 9,617,853 B2
(45) Date of Patent: Apr. 11, 2017

(54) AUXILIARY TUNNELING APPARATUS

(71) Applicant: KOMATSU LTD., Tokyo (JP)

(72) Inventors: Kazunari Kawai, Kawasaki (JP); Shinichi Terada, Kawasaki (JP); Yuuichi Kodama, Hiratsuka (JP); Masaaki Uetake, Kawasaki (JP); Hiroshi Asano, Kobe (JP); Takashi Minami, Nishinomiya (JP); Junya Tanimoto, Kyoto (JP)

(73) Assignee: KOMATSU LTD., Tokyo (JP)

( * ) Notice: Subject to any disclaimer, the term of this patent is extended or adjusted under 35 U.S.C. 154(b) by 112 days.

(21) Appl. No.: 14/394,538

(22) PCT Filed: Jun. 11, 2013

(86) PCT No.: PCT/JP2013/066106
§ 371 (c)(1),
(2) Date: Oct. 15, 2014

(87) PCT Pub. No.: WO2014/010359
PCT Pub. Date: Jan. 16, 2014

(65) Prior Publication Data

US 2015/0078831 A1 Mar. 19, 2015

(30) Foreign Application Priority Data

Jul. 9, 2012 (JP) ..... 2012-153529

(51) Int. Cl.
*E21D 9/01* (2006.01)
*E21D 9/11* (2006.01)
(Continued)

(52) U.S. Cl.
CPC ..... *E21D 9/1093* (2013.01); *E21D 9/008* (2016.01); *E21D 9/01* (2016.01); *E21D 9/112* (2013.01); *E21D 9/14* (2013.01); *E21F 17/00* (2013.01)

(58) Field of Classification Search
CPC . E21D 9/007; E21D 2009/008; E21D 9/1093; E21D 9/11; E21D 9/112; E21D 9/14; E21D 23/088; E21C 29/02
(Continued)

(56) References Cited

U.S. PATENT DOCUMENTS 3,963,080 A 6/1976 Walker
4,217,067 A 8/1980 Lagodka et al.
(Continued)

FOREIGN PATENT DOCUMENTS

CA 1081976 A 7/1980
CA 2 708 373 A1 6/2009
(Continued)

OTHER PUBLICATIONS

The Office Action for the related Chinese application No. 201380026346.2, issued on Sep. 2, 2015.
(Continued)

*Primary Examiner* — David Bagnell
*Assistant Examiner* — Michael Goodwin
(74) *Attorney, Agent, or Firm* — Global IP Counselors, LLP

(57) ABSTRACT

An auxiliary tunneling apparatus includes a reaction force receiver and first and second split components. In the excavation of a second tunnel by a boring machine, the reaction force receiver forms a replacement face of a side wall of the second tunnel on a first tunnel side where the first and second tunnels intersect each other, and a gripper of the boring machine pushes against the replacement face. The
(Continued)

first and second split components are installed to push against the side wall of the first tunnel, support the reaction force receiver within the first tunnel, and move back and forth with respect to the side wall of the first tunnel.

21 Claims, 13 Drawing Sheets

(51) Int. Cl.

| | |
|---|---|
| ***E21D 9/14*** | (2006.01) |
| ***E21D 9/10*** | (2006.01) |
| ***E21F 17/00*** | (2006.01) |
| ***E21D 9/00*** | (2006.01) |

(58) Field of Classification Search
USPC ..... 299/31, 55, 56, 58
See application file for complete search history.

(56) References Cited

U.S. PATENT DOCUMENTS

| | | | | |
|---|---|---|---|---|
| 4,747,730 | A * | 5/1988 | Urschitz | E21D 23/088 405/298 |
| 5,634,692 | A | 6/1997 | Kaneko et al. | |
| 2002/0031403 | A1 | 3/2002 | Konda et al. | |
| 2015/0078831 | A1 | 3/2015 | Kawai et al. | |

FOREIGN PATENT DOCUMENTS

| | | | |
|---|---|---|---|
| CN | 1327120 | A | 12/2001 |
| CN | 1381669 | A | 11/2002 |
| CN | 1532373 | A | 9/2004 |
| JP | 3-5600 | A | 1/1991 |
| JP | 8-226294 | A | 9/1996 |
| JP | 2000-303775 | A | 10/2000 |
| JP | 2002-106289 | A | 4/2002 |
| JP | 2002-364286 | A | 12/2002 |

OTHER PUBLICATIONS

The International Search Report for the corresponding international application No. PCT/JP2013/066106, issued on Jul. 9, 2013.
The Office Action for the related U.S. Appl. No. 14/394,586, issued on Sep. 23, 2015.
Office Action for the corrresponding Canadian patent application No. 2,871,420, issued on Nov. 16, 2015.
The Office Action for the corresponding Chinese application No. 23138003453.4, issued on Oct. 8, 2015.

* cited by examiner step S2 step S1 step S4 step S3 step S6 step S5 step S8 step S7

AUXILIARY TUNNELING APPARATUS

CROSS-REFERENCE TO RELATED APPLICATIONS

This application is a U.S. National stage application of International Application No. PCT/JP2013/066106, filed on Jun. 11, 2013. This U.S. National stage application claims priority under 35 U.S.C. §119(a) to Japanese Patent Application No. 2012-153529, filed in Japan on Jul. 9, 2012, the entire contents of which are hereby incorporated herein by reference.

BACKGROUND

Field of the Invention

The present invention relates to an auxiliary tunneling apparatus used in the excavation of intersecting tunnels.

Conventionally, tunnels are excavated using a boring machine equipped with a cutter head that includes cutters at the front of the machine, and grippers provided on the left and right sides to the rear of the machine.

This boring machine excavates the tunnel by rotating the cutter head while pressing it snugly in a state in which the left and right grippers push against the left and right side walls of the tunnel.

When a boring machine is used to excavate two or more tunnels that intersect each other, the side wall against which the grippers push disappears at the intersecting portion when a new tunnel is excavated that intersects with an existing tunnel, so excavation by the above-mentioned boring machine is impossible.

Japanese Laid-Open Patent Application 2002-364286 (laid open on Dec. 18, 2002), for example, discloses a reaction force receiving structure for use at a tunnel branch, where a reaction force resisting wall against which the gripper pushes at an intersection is provided by civil engineering work inside an existing tunnel.

SUMMARY

However, the following problem was encountered with the above-mentioned conventional reaction force receiving structure used at a tunnel branch.

Specifically, the reaction force receiving structure used at a tunnel branch disclosed in the above publication was installed by civil engineering work in an existing tunnel. Therefore, when there are a number of tunnel branches, the reaction force receiving structure has to be installed by civil engineering work at every intersection, and this job of installing the reaction force receiving structures takes a lot of time. As a result, there is the risk that tunnel construction efficiency by boring machine will end up being diminished.

It is an object of the present invention to provide an auxiliary tunneling apparatus with which there will be no drop in construction efficiency by a boring machine even when tunnel intersections are excavated.

The auxiliary tunneling apparatus pertaining to a first exemplary embodiment of the present invention is installed in a first tunnel that has already been excavated, in order to assist in excavation done with a boring machine that performs excavation by rotating a cutter head in a state in which a gripper pushes against a side wall, when the boring machine is used to excavate a second tunnel that intersects the first tunnel, the auxiliary tunneling apparatus comprising a reaction force receiver and a support component. The reaction force receiver forms a replacement face for the side wall of the second tunnel on the first tunnel side where the first and second tunnels intersect each other in the excavation of the second tunnel by the boring machine, and the gripper of the boring machine pushed against the replacement face. The support component is installed to push against the side wall of the first tunnel, supports the reaction force receiver inside the first tunnel, and is able to move back and forth with respect to the side wall of the first tunnel.

Here, a reaction force receiver that forms a replacement face that serves as part of the side wall of the second tunnel is provided on the existing first tunnel side to excavate an intersection between an existing first tunnel and a newly excavated second tunnel, by using a boring machine that performs excavation in a state in which left and right grippers push against the left and right side walls of the tunnel. A support component is provided that supports the reaction force receiver by pushing against the side walls of the first tunnel to fix the reaction force receiver at the desired position.

Because the reaction force receiver here forms a replacement face for the side wall of the second tunnel, it preferably has the same shape as the side wall of the second tunnel. Also, the support component preferably has a jack or other such mechanism for pushing against the side wall of the first tunnel. Furthermore, this auxiliary tunneling apparatus is equipped with wheels so that, in a state in which the support component is moved away from the side wall of the first tunnel, the device can travel or be towed, or can be placed on a truck or the like, allowing it to move within the tunnel.

Consequently, places where there is no side wall of the second tunnel because there is an intersection with the existing first tunnel can be blocked off with the replacement face of the reaction force receiver. Accordingly, a conventional boring machine that excavates while receiving reaction force from the side wall can continue excavating the intersecting portions of the first and second tunnels.

Also, with this auxiliary tunneling apparatus, the support component that supports the reaction force receiver within the first tunnel is provided in a state that allows movement back and forth with respect to the side wall of the first tunnel. Accordingly, the auxiliary tunneling apparatus can be easily moved at the point when the excavation of an intersection has been completed, and even if there are a plurality of tunnel intersections, the auxiliary tunneling apparatus can be easily moved to the desired location. This improves the efficiency of excavation work in a tunnel having intersections.

The auxiliary tunneling apparatus pertaining to a second exemplary embodiment of the present invention is the auxiliary tunneling apparatus pertaining to the first exemplary embodiment of the present invention, further comprising a travel component for traveling within the first and second tunnels.

Here, the auxiliary tunneling apparatus further comprises a travel component that allows for movement through the tunnel.

Consequently, at construction sites where there are a plurality of tunnel intersections, for example, this auxiliary tunneling apparatus can be moved to each of these intersections. This improves the efficiency of tunnel excavation work.

The auxiliary tunneling apparatus pertaining to a third exemplary embodiment of the present invention is the auxiliary tunneling apparatus pertaining to the second exemplary embodiment of the present invention, wherein the travel component has travel wheels and an engine or battery as a drive source for rotating the travel wheels.

Here, a self-propelled auxiliary tunneling apparatus equipped with travel wheels and an engine, battery, or the like is configured.

Therefore, this auxiliary tunneling apparatus can move under its own power through a tunnel, which improves the efficiency of excavation work that includes tunnel intersections.

The auxiliary tunneling apparatus pertaining to a fourth exemplary embodiment of the present invention is the auxiliary tunneling apparatus pertaining to the second exemplary embodiment of the present invention, wherein the travel component has travel wheels and linking components that are linked to a tow vehicle that can travel through the first and second tunnels.

Here, a towable auxiliary tunneling apparatus is configured by providing linking components that link the travel wheels to the tow vehicle.

Consequently, since this auxiliary tunneling apparatus can move through a tunnel by being towed by a tow vehicle, etc., this improves efficiency in excavation work that includes tunnel intersections.

The auxiliary tunneling apparatus pertaining to a fifth exemplary embodiment of the present invention is the auxiliary tunneling apparatus pertaining to any of the first to fourth exemplary embodiments of the present inventions, wherein the support components can be split up into a plurality of parts.

Here, the support component can be split up into a plurality of parts.

Consequently, even when the device is moving around a tunnel curve or the like, for example, it can pass smoothly since split movement is possible.

The auxiliary tunneling apparatus pertaining to a sixth exemplary embodiment of the present invention is the auxiliary tunneling apparatus pertaining to any of the first to fifth exemplary embodiments of the present invention, wherein the reaction force receiver is provided to the replacement face, and has an excavation part that can be excavated by the boring machine.

Here, because concrete or another such excavation part is provided to the surface of the portion that becomes the replacement face of the reaction force receiver.

Consequently, when the boring machine passes a tunnel intersection, the excavation part is cut by the cutter at the distal end, which allows the portion that becomes the replacement face of the reaction force receiver to have the same shape as the side wall of the second tunnel. Thus, there is no need to accurately match the shape of the replacement face of the reaction force receiver to the shape of the side wall of the second tunnel.

The auxiliary tunneling apparatus pertaining to a seventh exemplary embodiment of the present invention is the auxiliary tunneling apparatus pertaining to any of the first to fifth exemplary embodiments of the present invention, wherein the reaction force receiver has an angle adjustment mechanism for adjusting the angle of the replacement face.

Here, the angle adjustment mechanism adjusts the angle of the replacement face of the reaction force receiver.

Consequently, the angle of the portion that becomes the replacement face can be adjusted to match the shape of the side wall of the second tunnel.

The auxiliary tunneling apparatus pertaining to an eighth exemplary embodiment of the present invention is used in a tunnel and comprises a travel component, a support component, and a reaction force receiver. The travel component allows the auxiliary tunneling apparatus to be relocated. The support component that has a support jack. The support jack pushes against the tunnel side wall and allows the auxiliary tunneling apparatus to be fixed within the tunnel. The reaction force receiver is disposed at a first end of the support component in a direction that does not intersect the side wall of the tunnel, and has a face that spreads out in a direction that intersects the side wall of the tunnel.

Consequently, when a tunnel that intersects with an existing tunnel is to be excavated with a boring machine, the reaction force needed for excavation at the intersection can be obtained. At the same time, the reaction force receiver used for excavation of the tunnel intersection can be easily installed and relocated, so this simplifies the intersection excavation process when there are a number of intersections.

DETAILED DESCRIPTION OF EXEMPLARY EMBODIMENTS

The auxiliary tunneling apparatus pertaining to an exemplary embodiment of the present invention, as well as a tunnel excavation method in which this apparatus is used, will now be described through reference to FIGS. 1 to 10B.

Figure 4B:
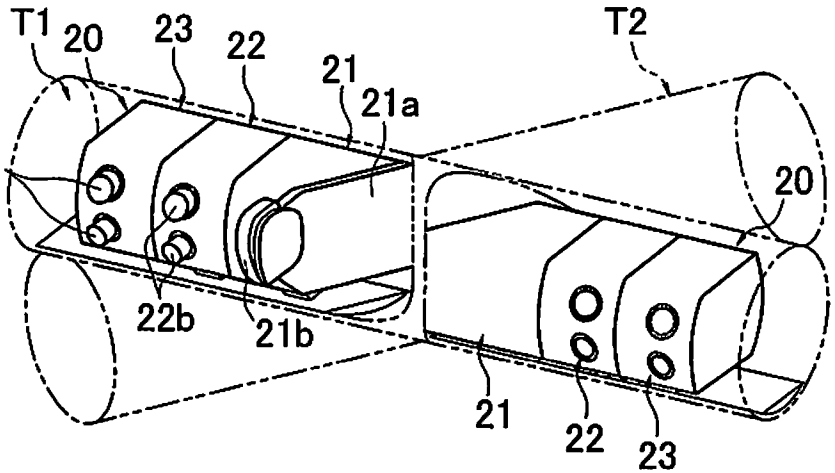
FIGS. 4 A and 4B are a plan view and an oblique view of a state in which the auxiliary tunneling apparatus in FIG. 2 has been installed in a tunnel.

The boring machine 10 (FIG. 1, etc.) that appears in this exemplary embodiment is a TBM (tunnel boring machine), but more specifically is known as a gripper TBM or a hard rock TBM. In this exemplary embodiment, as shown in FIG. 4B, the tunnels (first and second tunnels T1 and T2) that are excavated with the boring machine 10 are both tunnels whose cross section is substantially circular. The cross sectional shape of the tunnel pertaining to the exemplary embodiments of the present invention is not limited to being circular, though, and may instead be elliptical, double circular, horseshoe shaped, or the like.

Configuration of Boring Machine 10

Figure 1:
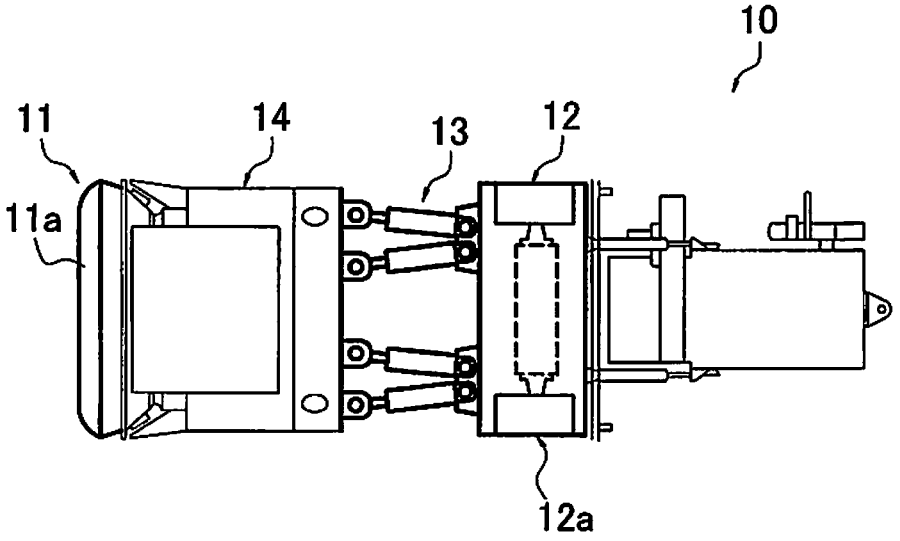
FIG. 1 is a side view of the configuration of a boring machine used in a tunnel excavation method involving the auxiliary tunneling apparatus pertaining to an exemplary embodiment of the present invention.
Figure 2:
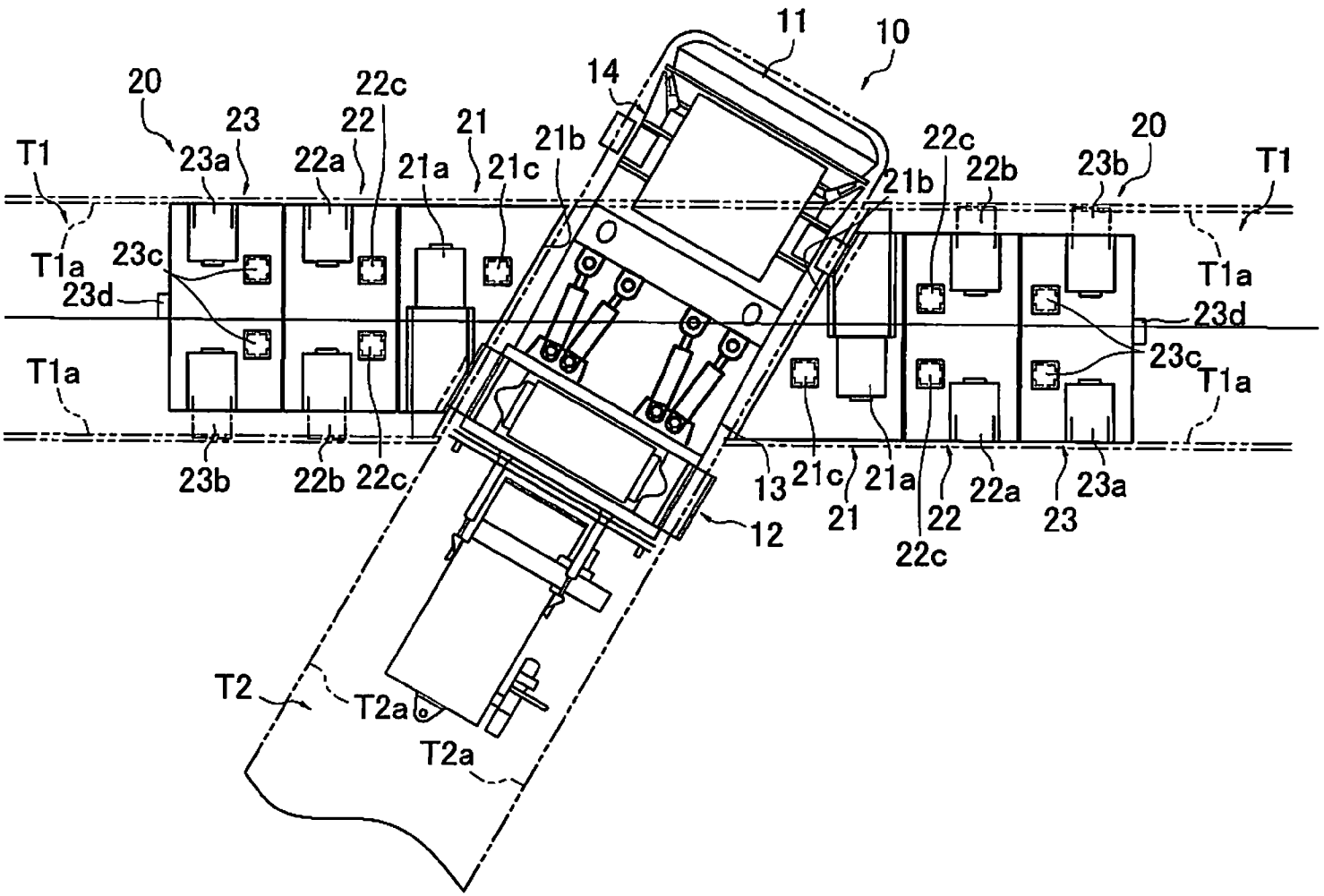
FIG. 2 is a cross section of a state in which tunnel excavation is performed using the boring machine in FIG. 1 and the auxiliary tunneling apparatus in this exemplary embodiment.

In this exemplary embodiment, the boring machine 10 shown in FIG. 1 is used to excavate the first and second tunnels T1 and T2 (see FIG. 2, etc.). The boring machine 10 described in this exemplary embodiment is one with a typical configuration with which excavation is performed by rotating a cutter head while it is supported rearward by a gripper 12*a*.

The boring machine 10 is used to perform excavation work in a tunnel by moving forward while excavating solid rock. As shown in FIG. 1, the boring machine 10 comprises a cutter head 11, the gripper 12*a*, and a thrust jack 13.

As shown in FIG. 1, the cutter head 11 is disposed on the front end side of the boring machine 10, and excavates rock and the like with a plurality of disk cutters 11*a* provided on the front end surface by rotating around the center axis of the substantially circular tunnel. The cutter head 11 takes bedrock, stones, and so forth that have been finely crushed by the disk cutters 11*a* into its interior through an opening (not shown) formed in the surface.

As shown in FIG. 1, a gripper mounting component 12 is disposed on the rear side of the boring machine 10, and constitutes the rear body of the boring machine 10. The grippers 12*a* are provided on both sides in the width direction of the gripper mounting component 12.

As shown in FIG. 2, the grippers 12*a* push against the side wall T2*a* of the second tunnel T2 being excavated, and this supports the boring machine 10 within the second tunnel T2.

As shown in FIG. 1, the thrust jack 13 is disposed in the middle of the boring machine 10, and constitutes the middle body of the boring machine 10. The thrust jack 13 expands or contracts between the cutter head 11 and the grippers 12*a* to move the boring machine 10 a little at a time through the second tunnel T2 while excavating.

As shown in FIG. 1, a support component 14 is disposed between the cutter head 11 and the thrust jack 13, and constitutes the front body of the boring machine 10 along with the cutter head 11. The support component 14 supports the front body of the boring machine 10 within the second tunnel T2.

Because the boring machine 10 is configured as above, the grippers 12*a* push against the side wall T2*a* of the second tunnel T2, so that the boring machine 10 is held so that it will not move within the second tunnel T2, and in this state the thrust jack 13 is extended while the cutter head 11 at the front side is rotated, so that the cutter head 11 pushes snugly in place, and the excavation proceeds through the rock, etc. At this point, with the boring machine 10, the finely crushed rock and so forth is conveyed rearward on a conveyor belt (not shown) or the like. This allows the boring machine 10 to excavate deeper into the second tunnel T2 (see FIG. 2).

That is, with the boring machine 10, the grippers 12*a*, which are disposed further to the rear than the cutter head 11 that performs excavation, push against the side wall T2*a* of the second tunnel T2 during excavation, and this is a prerequisite to excavate into the second tunnel T2.

Configuration of Auxiliary Tunneling Apparatus 20

As shown in FIG. 2, the auxiliary tunneling apparatus 20 pertaining to this exemplary embodiment is installed on the existing first tunnel T1 side at the intersection between the first and second tunnels T1 and T2 during the excavation of the second tunnel T2, which intersects the first tunnel T1. Two of the auxiliary tunneling apparatuses 20 are installed in the first tunnel T1 to flank the second tunnel T2 from both sides at the intersection of the first and second tunnels T1 and T2.

As the second tunnel T2 is being excavated, the auxiliary tunneling apparatus 20 from a replacement face that will become a replacement for the side wall T2*a*, at the portion where there is no side wall T2*a*, formed at the intersection between the first tunnel T1 and the second tunnel T2 in the excavation of the second tunnel T2.

More precisely, as shown in FIG. 2, the auxiliary tunneling apparatus 20 comprises a reaction force receiver 21 and first and second split components 22 and 23.

Reaction Force Receiver 21

The reaction force receiver 21 is provided on the existing first tunnel T1 side to form a replacement face in the portion where there is no side wall of the second tunnel T2, which occurs at the intersection of the first and second tunnels T1 and T2. As shown in FIG. 2, the reaction force receiver 21 is disposed at the front of the auxiliary tunneling apparatus 20, and has a receiver body 21*f*, a jack 21*a*, a reaction force receiving face (replacement face) 21*b*, travel wheels (travel components) 21*c*, and a cut component 21*d*. The front of the auxiliary tunneling apparatus 20 is a first end of a support component 22*a* (discussed below) in a direction that does not intersect with the side wall of the first tunnel T1, and is on the side where the second tunnel T2 is. The reaction force receiving face has a face that spreads out in a direction that intersects with the side wall of the first tunnel T1.

The jack 21*a* is provided to be able to move back and forth with respect to the side wall T1*a* of the first tunnel T1 to dispose the reaction force receiving face 21*b* as the replacement face for the side wall T2*a* at the portion where there is no side wall T2*a* of the second tunnel T2, which occurs at the intersection of the first and second tunnels T1 and T2. As shown in FIG. 3D, two of these jacks 21*a* are aligned vertically on the side face of the reaction force receiver 21.

Figure 3A:
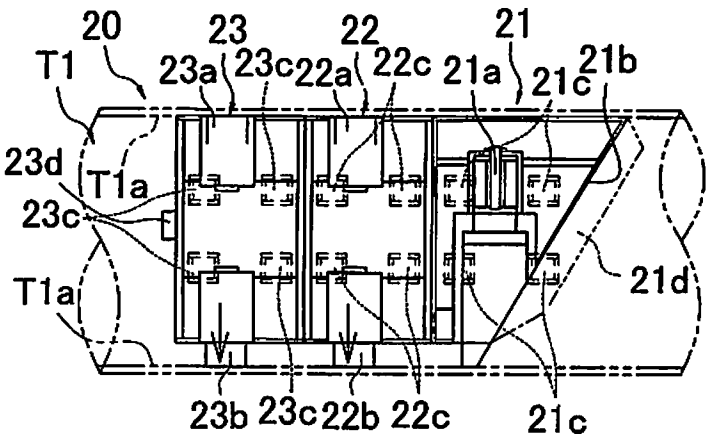
FIG. 3A is a plan view of a state in which the auxiliary tunneling apparatus in FIG. 2 has been installed in a tunnel.
Figure 3D:
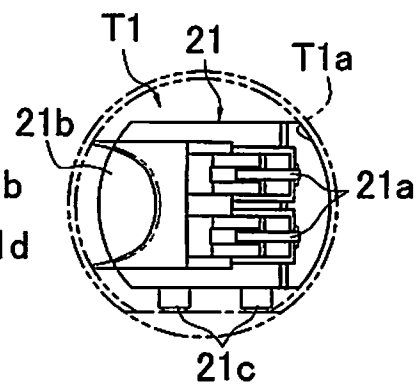
FIG. 3D is a front cross section.
Figure 4A:
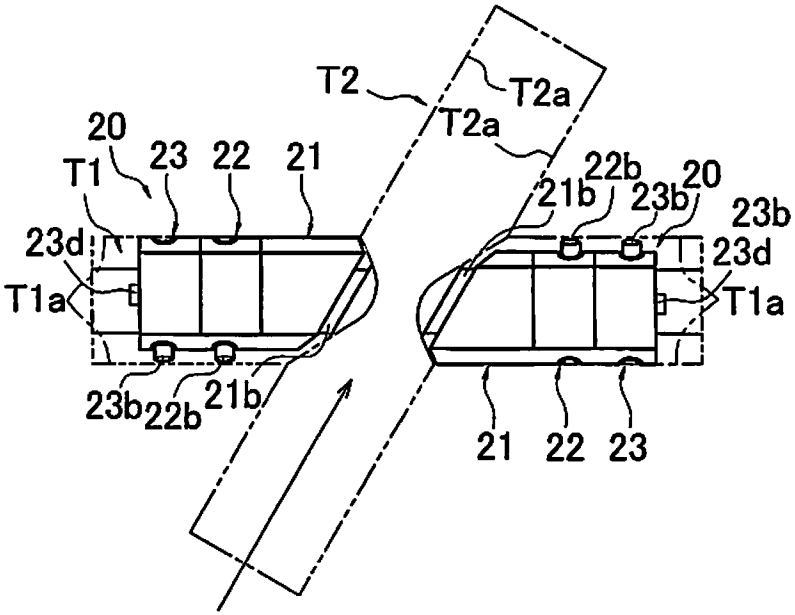

That is, when the auxiliary tunneling apparatus 20 is installed at the intersection of the first and second tunnels T1 and T2, the jacks 21*a* move the reaction force receiving face 21*b* to a specific protrusion position to be part of the side wall T2*a* of the second tunnel T2 being excavated by the boring machine 10, as shown in FIGS. 3A, 4A, etc.

Figure 5A:
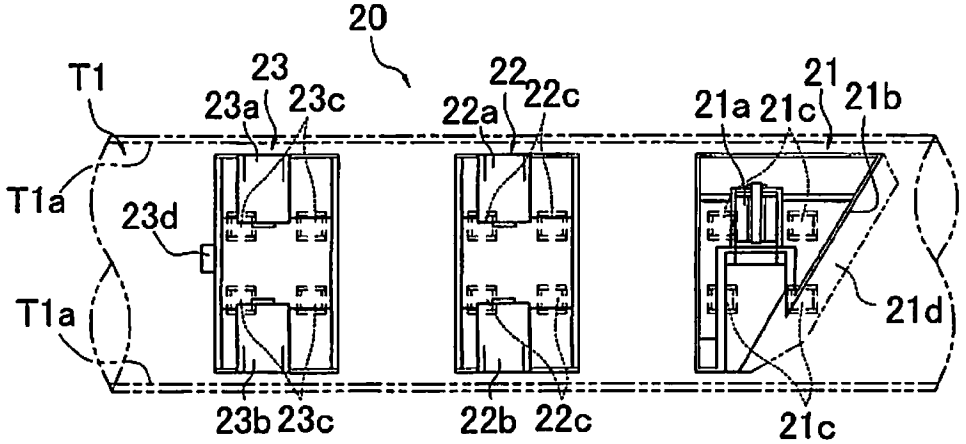
FIG. 5A is a plan view of a state in which the auxiliary tunneling apparatus in FIG. 2 is able to move within the tunnel.
Figure 6B:
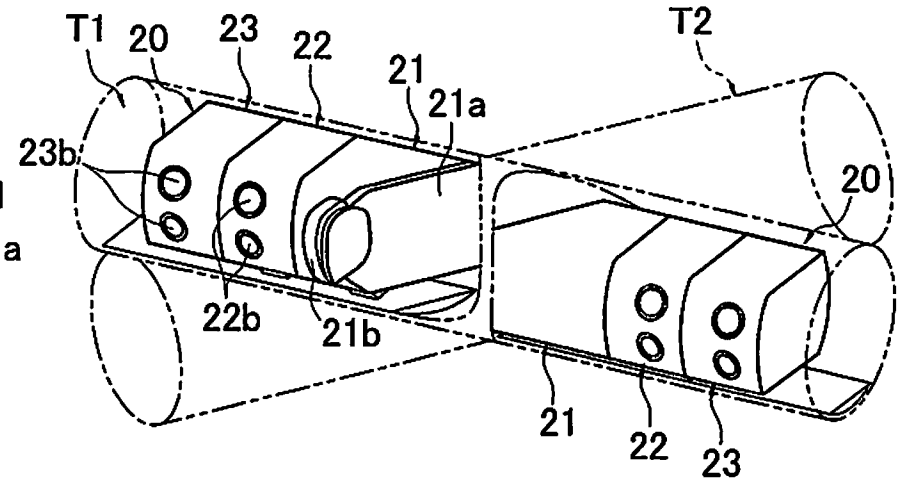
FIGS. 6A and 6B are a plan view and an oblique view of a state in which the auxiliary tunneling apparatus in FIG. 2 is able to move within the tunnel.
Figure 6A:
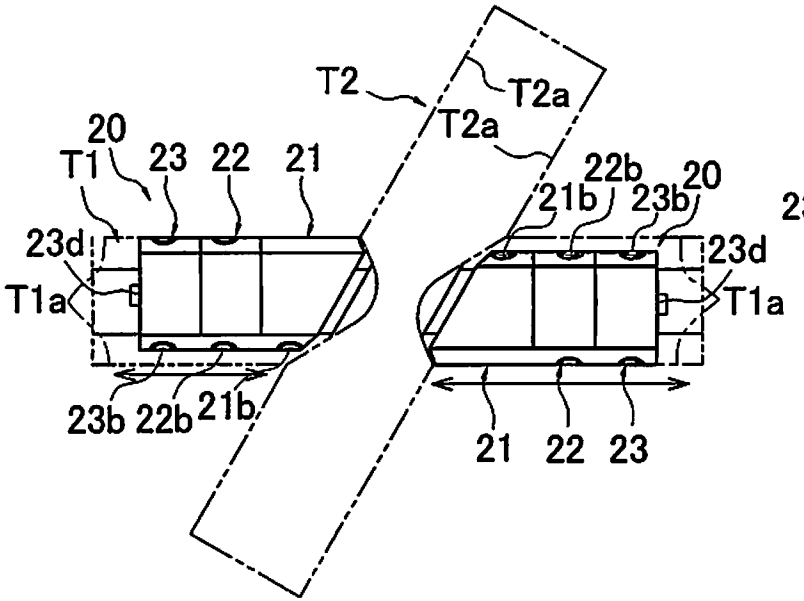

Meanwhile, when the auxiliary tunneling apparatus 20 moves through the first tunnel T1, as shown in FIGS. 5A, 6A, etc., the jacks 21*a* are moved to a specific retraction position to dispose the auxiliary tunneling apparatus 20 at the intersection of the first and second tunnels T1 and T2.

The reaction force receiving face 21*b* is provided to the reaction force receiver 21 in a state in which it can be moved back and forth by the jacks 21*a*, and constitutes part of the side wall T2*a* of the second tunnel T2 being excavated after moving to the specific protrusion position. In the illustrated embodiment, the reaction force receiving face 21*b* is concavely curved (recessed) toward the whole (body) of the reaction force receiver 21. The reaction force receiving face 21*b* preferably has a shape that corresponds to the shape of an internal side wall of the second tunnel T2.

Four of the travel wheels 21*c* are provided to go on the bottom face of the first tunnel T1, as shown in FIG. 3A, to allow the reaction force receiver 21 (the auxiliary tunneling apparatus 20) to travel through the tunnel.

The cut component 21*d* is formed by spraying on concrete or the like to the desired thickness on the surface of the reaction force receiving face 21*b*. The cut component 21*d* is partially cut away by the boring machine 10 during the excavation of the second tunnel 12, which allows a replacement face to be easily formed in substantially the same shape as that of the side wall T2*a* of the second tunnel T2.

Consequently, there is no need for the shape of the reaction force receiving face 21*b* or the angle of the reaction force receiving face 21*b* to be accurately matched to the shape of the side wall T2*a* of the second tunnel T2.

First Split Component 22

The first split component 22 is provided to support the auxiliary tunneling apparatus 20 within the first tunnel T1, and is linked to the rear part of the reaction force receiver 21 as shown in FIG. 2. As shown in FIG. 3A, the first split component 22 has a first body 22*f*, a support jack (support component) 22*a*, a support jack (support component) 22*b*, and travel wheels 22*c*. In this exemplary embodiment, the reaction force receiver 21 and the first split component 22 are linked, but the reaction force receiver 21 and the first split component 22 may instead come into contact during tunnel construction, rather than being linked.

The support jack 22*a* is provided in a state of being able to move back and forth with respect to the side wall T1*a* of the first tunnel T1, within the first tunnel T1 in which the auxiliary tunneling apparatus 20 is installed.

The support jack 22*b* is provided to the side face on the opposite side from the support jack 22*a*, and just as with the support jack 22*a*, is provided in a state of being able to move back and forth with respect to the side wall T1*a* of the first tunnel T1.

That is, as shown in FIGS. 2, 3A, etc., the support jacks 22*a* and 22*b* move one of the side faces to the protrusion position during the fixing of the auxiliary tunneling apparatus 20 in the first tunnel T1, which allows the other face of the first split component 22 to push against the side wall T1*a* of the first tunnel T1. Thus the push of the support jacks 22*a* and 22*b* against the first side walls of the tunnel T1 keeps the first split component 22 in an immobile state within the first tunnel T1.

As shown in FIG. 3A, four of the travel wheels 22*c* are provided to go on the bottom face of the first tunnel T1, so that the first split component 22 (the auxiliary tunneling apparatus 20) can travel through the tunnel.

Second Split Component 23

The second split component 23 is similar to the first split component 22 in that it is provided to support the auxiliary tunneling apparatus 20 within the first tunnel T1, and as shown in FIG. 2, it is linked to the rear part of the first split component 22. As shown in FIG. 3A, the second split component 23 has a second body 23*f*, a support jack (support component) 23*a*, a support jack (support component) 23*b*, travel wheels 23*c*, and a linking component 23*d*.

Figure 3C:
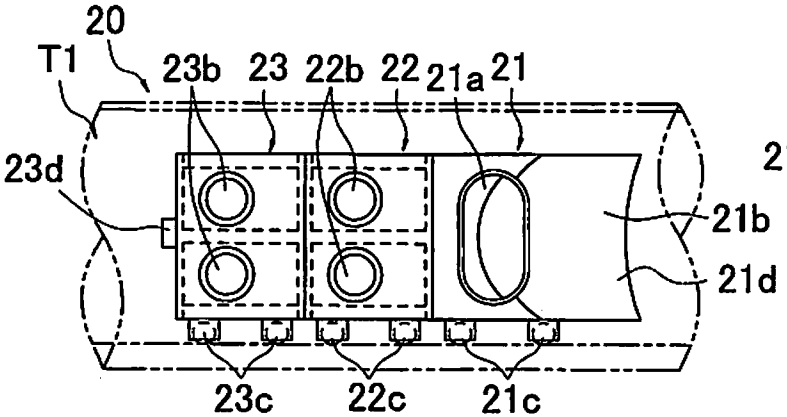
FIG. 3C is a side view thereof.
Figure 3B:
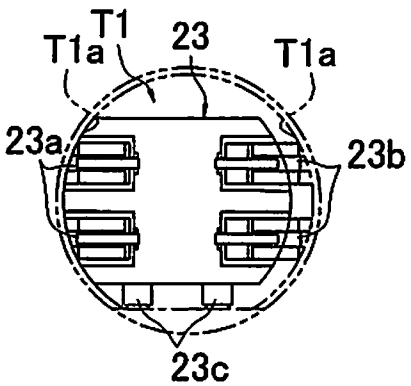
FIG. 3B is a cross section of the rear end side thereof.

The support jack 23*a* is provided in a state of being able to move back and forth with respect to the side wall T1*a* of the first tunnel T1 within the first tunnel T1 in which the auxiliary tunneling apparatus 20 is installed. As shown in FIG. 3B, two of these support jacks 23*a* are aligned vertically on the side face of the second split component 23.

The support jacks 23*b* are provided on the side face on the opposite side from the support jacks 23*a*, and just as with the support jacks 23*a*, are provided in a state of being able to move back and forth with respect to the side wall T1*a* of the first tunnel T1. Also, just as with the support jacks 23*a*, two of the support jacks 23*b* are aligned vertically on the side face of the second split component 23 on the opposite side from the support jacks 23*a*, as shown in FIGS. 3B and 3C.

That is, as shown in FIGS. 2, 3A, etc., the support jacks 23*a* and 23*b* move from one of the side faces to the protrusion position during the fixing of the auxiliary tunneling apparatus 20 within the first tunnel T1, which pushes the other face of the second split component 23 against the side wall T1*a* of the first tunnel T1. Consequently, the second split component 23 is kept in an immobile state within the first tunnel T1.

Four of the travel wheels 23*c* are provided to go on the bottom face of the first tunnel T1, as shown in FIG. 3A, to allow the second split component 23 (the auxiliary tunneling apparatus 20) to travel through the tunnel.

The linking component 23*d* is provided to the rear end face of the second split component 23, and links the auxiliary tunneling apparatus 20 to a tow vehicle (not shown).

Fixed State of Auxiliary Tunneling Apparatus 20

As discussed above, the auxiliary tunneling apparatus 20 in this exemplary embodiment is disposed on the first tunnel T1 side to provide a replacement face for the side wall of the second tunnel T2 during the excavation of the second tunnel T2, which intersects the existing first tunnel T1.

When the second tunnel T2 is being excavated by the boring machine 10, the excavation proceeds while the grippers 12*a* push against the side wall T2*a* of the second tunnel T2, so the replacement face for the side wall T2*a* installed by the auxiliary tunneling apparatus 20 is subjected to high pressure from the grippers 12*a*. Thus, the auxiliary tunneling apparatus 20 needs to withstand the pressure of the grippers 12*a* within the existing first tunnel T1.

In view of this, with the auxiliary tunneling apparatus 20 in this exemplary embodiment, when pressure is exerted by the grippers 12*a* of the boring machine 10, the support jacks 22*b* and 23*b* protrude from one side face of the first and second split components 22 and 23 as shown in FIGS. 3A to 4B so that the device will not move within the first tunnel T1.

Consequently, as shown in FIG. 4A, the first and second split components 22 and 23 are pressed on one side against the side wall T1*a* of the first tunnel T1. Therefore, even when pressure is exerted on the reaction force receiving face 21*b* of the reaction force receiver 21 from the grippers 12*a* of the boring machine 10 during excavation of the second tunnel T2, the entire auxiliary tunneling apparatus 20 can be held still so that it does not move within the first tunnel T1.

In this exemplary embodiment, one of the support jacks is thus extended in the width direction of the first and second split components 22 and 23, and therefore the first and second split components 22 and 23 are fixed with respect to the tunnel side wall, but both support jacks in the width direction may also be extended.

Movable State of Auxiliary Tunneling Apparatus 20

Meanwhile, when the auxiliary tunneling apparatus 20 performs excavation work in which there are a plurality of intersections of the first and second tunnels T1 and T2, for example, the support jacks 22*b* and 23*b* protruding from one side face of the first and second split components 22 and 23 are moved to their retracted position as shown in FIGS. 5A to 6B during the smooth installation of the replacement face for the side wall T2*a* of the second tunnel T2 at each intersection.

Figure 5C:
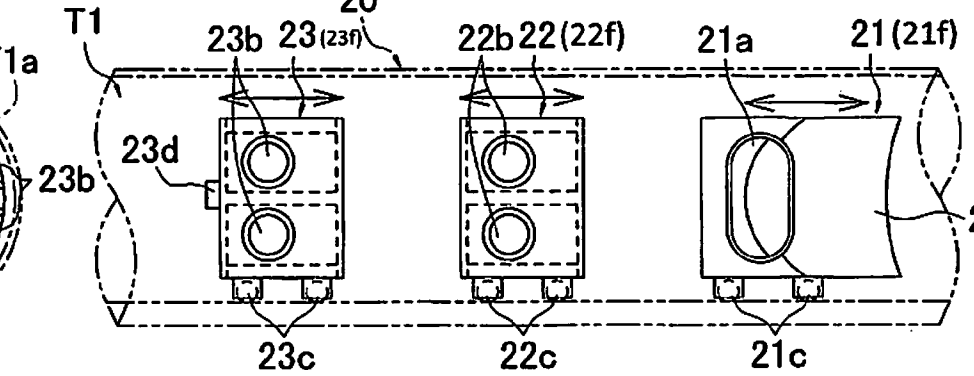
FIG. 5C is a side view thereof.
Figure 5B:
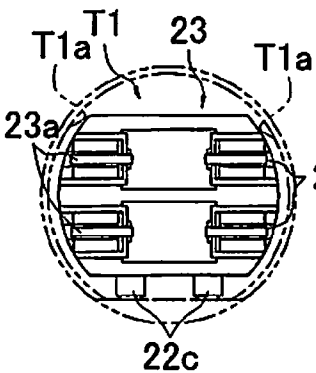
FIG. 5B is a cross section of the rear end side thereof.
Figure 5D:
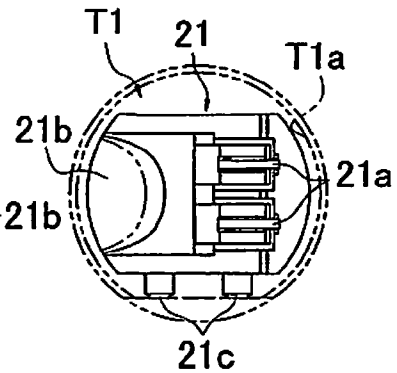
FIG. 5D is a front cross section thereof.

As shown in FIG. 5C, etc., the auxiliary tunneling apparatus 20 here has the travel wheels 21*c*, 22*c*, and 23*c* on the bottom faces of the reaction force receiver 21 and the first and second split components 22 and 23.

Consequently, the linking component 23*d* of the second split component 23 can be linked to a tow vehicle (not shown), allowing the auxiliary tunneling apparatus 20 to be smoothly towed by the tow vehicle and relocated within the first and second tunnels T1 and T2. In this exemplary embodiment, as discussed above, the device is moved through the tunnel by the rolling of the travel wheels 21*c*, 22*c*, and 23*c* on the bottom faces, but skids may instead be provided to the device bottom face, and the device moved by sliding.

Furthermore, curve portions and so forth need to be negotiated to move the auxiliary tunneling apparatus 20 up to the next intersection of the first and second tunnels T1 and T2.

In view of this, as shown in FIG. 5C, with the auxiliary tunneling apparatus 20 in this exemplary embodiment the reaction force receiver 21 and the first and second split components 22 and 23 can be split apart and moved. Also, because the auxiliary tunneling apparatus 20 employs a structure in which it is split into a plurality of blocks (the reaction force receiver 21 and the first and second split components 22 and 23), an effect can be obtained whereby it is easier to negotiate curves and so forth. Also, since the device can be longer while still being able to negotiate curves, the planar pressure of the support components on the tunnel side walls can be lowered. Furthermore, because the reaction force receiver 21 and the first and second split components 22 and 23 are separated, tunnels of different intersection angles can be built by changing out just the reaction force receiver 21.

Effect of Auxiliary Tunneling Apparatus 20

As shown in FIG. 2, the auxiliary tunneling apparatus 20 of this exemplary embodiment is installed on the first tunnel T1 side in the excavation of the second tunnel T2 that intersects the existing first tunnel T1, by using the boring machine 10 to perform excavation in a state in which the grippers 12*a* push against the side wall T2*a*. The auxiliary tunneling apparatus 20 comprises the reaction force receiver 21, which includes the reaction force receiving face 21*b* that serves as a replacement face at the intersection between the first and second tunnels T1 and T2 where there is no side wall T2*a* of the second tunnel T2, and the first and second split components 22 and 23, which include the support jacks 22*a* and 22*b* and the support jacks 23*a* and 23*b* for supporting the reaction force receiver 21 so that it does not move through the first tunnel T1.

Consequently, the reaction force receiving face 21*b* that serves as a replacement face for the side wall T2*a* of the second tunnel T2 can be installed at the intersection between the first and second tunnels T1 and T2. Thus, the excavation work using the boring machine 10 at the intersection of the mutually intersecting first and second tunnels T1 and T2 can be carried out more smoothly than in the past. As a result, even when excavating the mutually intersecting first and second tunnels T1 and T2, the time it takes to carry out the tunnel excavation work will be shorter than in the past.

The auxiliary tunneling apparatus 20 in this exemplary embodiment has all of the travel wheels 21*c*, 22*c*, and 23*c* provided to the reaction force receiver 21 and the first and second split components 22 and 23 constituting the auxiliary tunneling apparatus 20. Accordingly, the auxiliary tunneling apparatus 20 can be towed in a state in which the linking component 23*d* is linked to a tow vehicle (not shown), allowing it to be moved freely through the first and second tunnels T1 and T2.

As discussed above, the auxiliary tunneling apparatus 20 in this exemplary embodiment is configured so that the reaction force receiver 21 and the first and second split components 22 and 23 are split into three.

Consequently, this split structure can be used to allow the auxiliary tunneling apparatus 20 to negotiate curves in the tunnel, including the first and second tunnels T1 and T2.

The auxiliary tunneling apparatus 20 in this exemplary embodiment comprises the cut component 21*d*, which is formed by spraying on concrete or the like to at least a specific thickness at the portion of the reaction force receiver 21 facing the second tunnel T2.

Consequently, when the second tunnel T2 is being excavated by the boring machine 10, part of the reaction force receiving face 21*b* will be cut away by the cutter head 11 at the distal end of the boring machine 10, in a shape that is substantially the same as the shape of the side wall T2*a* of the second tunnel T2. Thus, when the boring machine 10 subsequently moves forward, the grippers 12*a* can be brought into contact with the reaction force receiving face 21*b* in the same state as with the side wall T2*a* of the second tunnel T2. Thus, there is no need to worry about accurately adjusting the angle of the reaction force receiving face 21*b* or forming the shape of the reaction force receiving face 21*b* to match the shape of the side wall T2*a* of the second tunnel T2.

Tunnel Excavation Method

The tunnel excavation method pertaining to this exemplary embodiment will now be described through reference to FIGS. 7A to 10B.

In this exemplary embodiment, the tunnel is excavated according to the following procedure, using the above-mentioned boring machine 10 and auxiliary tunneling apparatus 20.

Figure 7B:
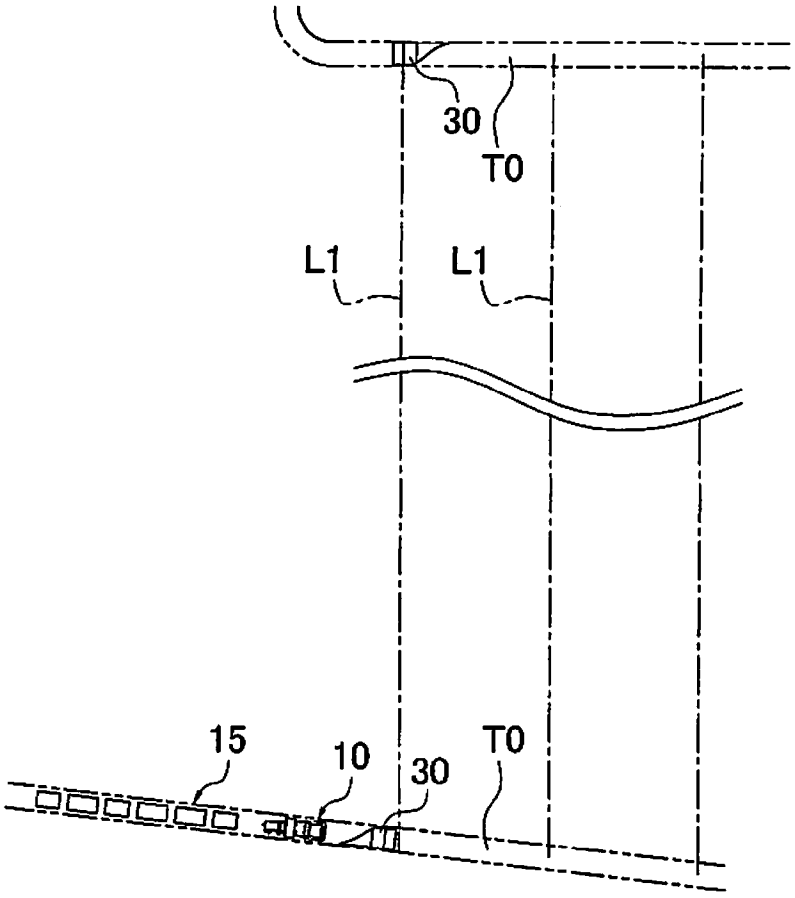
FIGS. 7A and 7B show the procedure for tunnel excavation by the tunnel excavation method pertaining to an exemplary embodiment of the present invention.
Figure 7A:
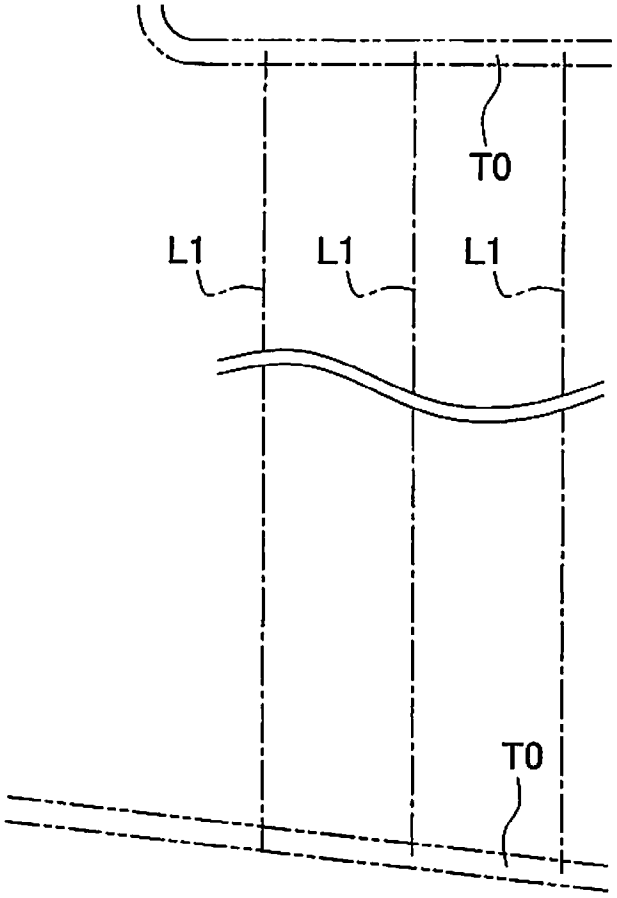

First, as shown in FIG. 7A, in step S1, a first excavation line L1 is set to excavate three first tunnels T1 that are substantially parallel to each other, from an existing two tunnels T0.

Then, as shown in FIG. 7B, in step S2, the boring machine 10 follows a backup trailer 15 equipped with a drive source or the like for the boring machine 10, and the boring machine 10 is moved by a tow vehicle to a position where an existing tunnel T0 branches off to a first tunnel T1.

At this point, a corner-use reaction force receiver 30 is installed at the portion where the existing tunnel T0 branches off to the first tunnel T1. Consequently, the boring machine 10 is able to keep excavating the first tunnel T1 while the grippers 12*a* are kept in contact with the reaction force receiver 30, even at the bent portions that branch off to the first tunnel T1.

Here, the reaction force receiving face of the corner-use reaction force receiver 30 preferably has the same shape as the side wall T1*a* of the first tunnel T1. Alternatively, the cut component 21*d* may be provided to the surface, as with the reaction force receiving face 21*b* of the auxiliary tunneling apparatus 20 discussed above, and given a shape that will better conform to the grippers 12*a* while the boring machine 10 is excavating.

Figure 8B:
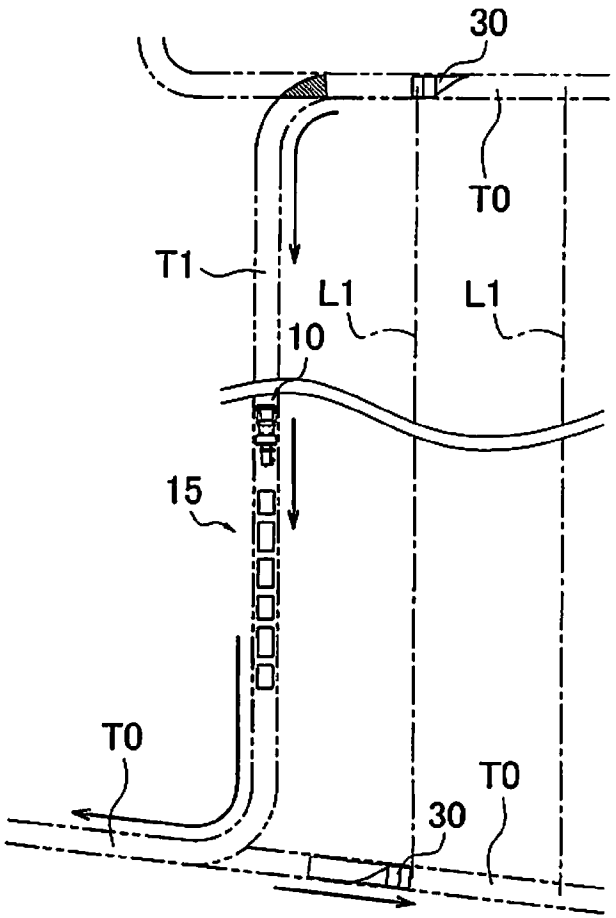
FIGS. 8A and 8B show the procedure for tunnel excavation by the tunnel excavation method pertaining to an exemplary embodiment of the present invention.
Figure 8A:
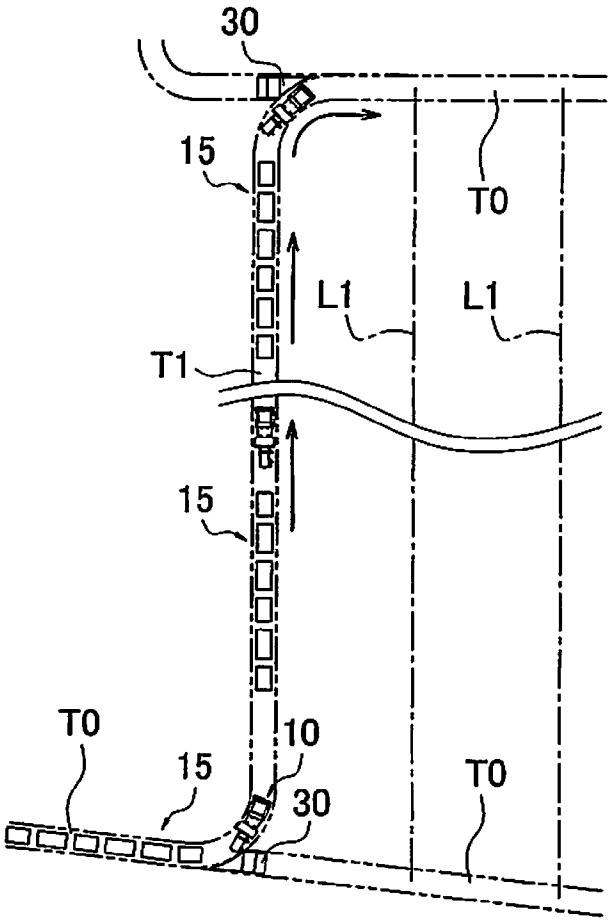

Then, as shown in FIG. 8A, in step S3, the boring machine 10 and the backup trailer 15 are moved while the boring machine 10 excavates solid rock, etc., along the first excavation line L1. This allows the first tunnel T1 to be formed in the desired location.

Then, as shown in FIG. 8B, in step S4, once the excavation up to the existing tunnel T0 formed at an isolated position is complete, and the first tunnel T1 passes through the tunnel T0, the boring machine 10 and the backup trailer 15 are returned by the tow vehicle to the initial positions shown in FIG. 7B.

As shown in FIG. 8A, just as in step S2, the corner-use reaction force receiver 30 is installed at the portion where the first tunnel T1 reaches the tunnel T0.

Figure 9B:
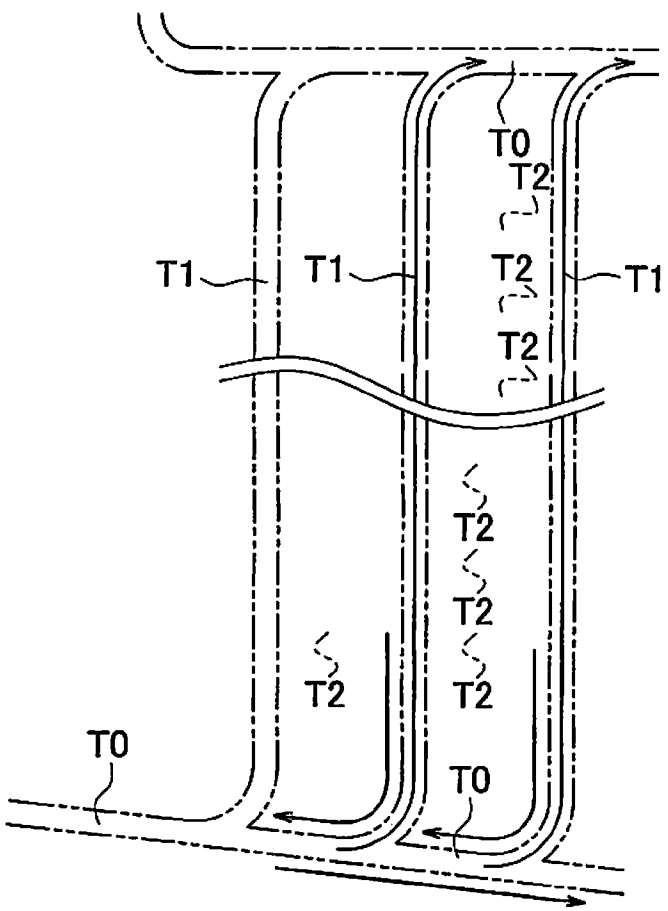
FIGS. 9A and 9B show the procedure for tunnel excavation by the tunnel excavation method pertaining to an exemplary embodiment of the present invention.
Figure 9A:
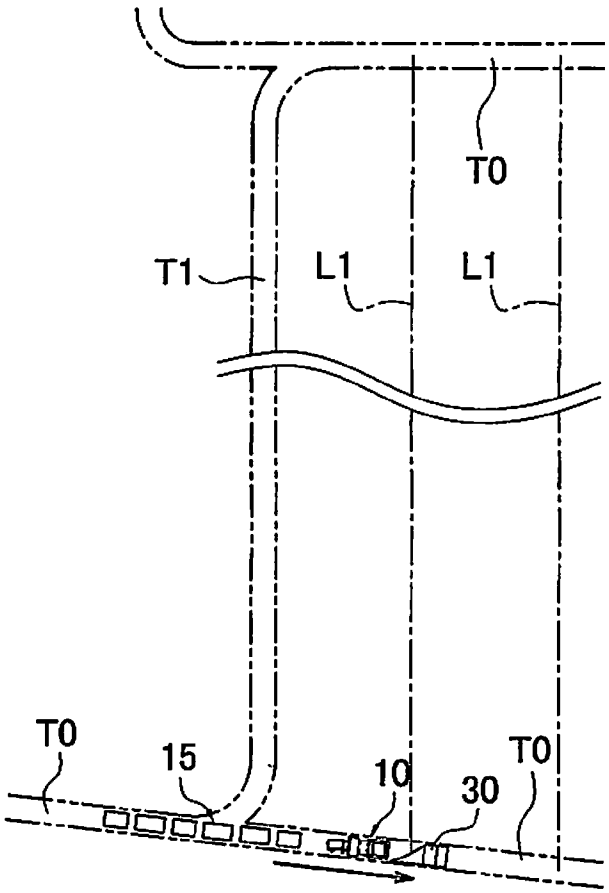

Then, as shown in FIG. 9A, in step S5 (first excavation step), the boring machine 10 is again moved along the first excavation line L1 to excavate a new first tunnel T1 that is substantially parallel to the excavated first tunnel T1.

Then, as shown in FIG. 9B, in step S6 (first excavation step), the above-mentioned steps S3 to S5 are repeated to excavate three first tunnels T1 that are substantially parallel to each other, after which a second excavation line L2 is set to form a plurality of second tunnels T2 that intersect these three first tunnels T1.

Figure 10B:
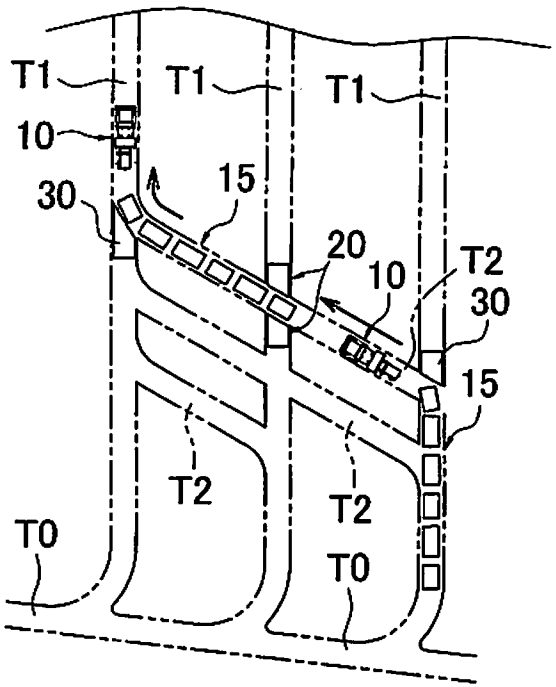
FIGS. 10A and 10B show the procedure for tunnel excavation by the tunnel excavation method pertaining to an exemplary embodiment of the present invention.
Figure 10A:
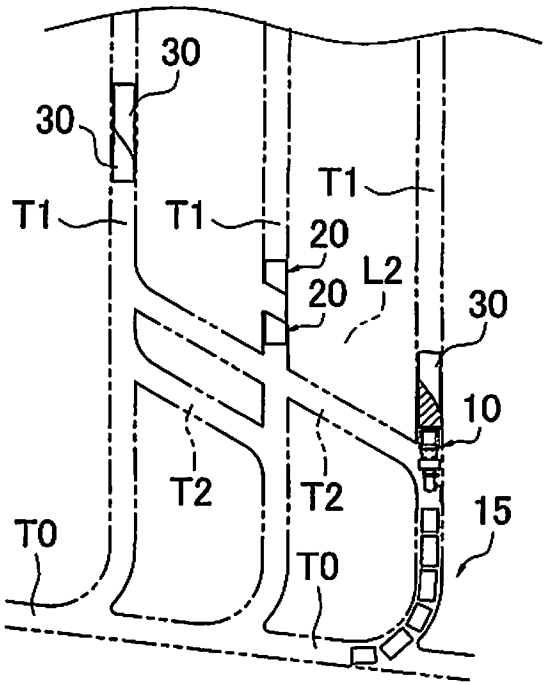

Then, as shown in FIG. 10A, in step S7 (second excavation step), the boring machine 10 and the backup trailer 15 are moved while the boring machine 10 excavates solid rock, etc., along the first second excavation line L2. This allows the second tunnel T2, which intersects the existing first tunnel T1, to be formed in the desired location.

At this point, two of the above-mentioned auxiliary tunneling apparatuses 20 are installed on the first tunnel T1 side at the portion where the existing first tunnel T1 and the second excavation line L2 intersect, flanking the above-mentioned intersection. Also, the above-mentioned corner-use reaction force receivers 30 are installed at each of the portions where the first tunnel T1 branches off to the second tunnel T2, and where they come together.

Then, as shown in FIG. 10B, in step S8 the boring machine 10 moves along the second excavation line L2, passing through the intersection of the first and second tunnels T1 and T2, and excavating up to the merge with the existing first tunnel T1.

After the boring machine 10 has passed the intersection at which the auxiliary tunneling apparatus 20 is installed, the auxiliary tunneling apparatus 20 is towed by a tow vehicle or the like, and is then moved to the intersection between the first and second tunnels T1 and T2 through which the boring machine 10 passes (movement step).

The rest of the steps involved in excavating the second tunnel T2 will not be described here.

Effects of this Tunnel Excavation Method

As shown in FIGS. 7A to 10B, the tunnel excavation method in this exemplary embodiment comprises a step of excavating three tunnels T1 that are substantially parallel to each other (first excavation step), and a step of excavating second tunnels T2 that intersect the first tunnels T1 (second excavation step), using the boring machine 10, which performs excavation in a state in which the grippers 12*a* push against the side walls of the tunnel.

Consequently, in tunnel excavation that includes portions where a plurality of tunnels branch and merge, the boring machine 10 need only move in a substantially straight line, so the tunnel excavation work takes less time than in the past.

With the tunnel excavation method in this exemplary embodiment, in the step of excavating the second tunnel T2 that intersects the existing first tunnel T1, the auxiliary tunneling apparatus 20, which comprises the reaction force receiver 21 that forms a replacement face for the side wall T2*a* of the second tunnel T2, is disposed at the portion where the first and second tunnels T1 and T2 intersect.

Consequently, the reaction force receiving face 21*b* that becomes the replacement face can be provided at the portion of the second tunnel T2 where there is no side wall T2*a*, which occurs at the intersection of the first and second tunnels T1 and T2. Thus, in tunnel excavation that includes a plurality of tunnel intersections, the work can be performed more efficiently than in the past, and the work will take less time.

With the tunnel excavation method in this exemplary embodiment, in tunnel excavation in which a plurality of intersections between the first and second tunnels T1 and T2 are formed, once the boring machine 10 passes an intersection where the auxiliary tunneling apparatus 20 is installed, the auxiliary tunneling apparatus 20 is then moved to the intersection passed by the boring machine 10.

Consequently, even when there are a plurality of intersections of the first and second tunnels T1 and T2, excavation by the boring machine 10 can still be carried out smoothly. This allows the tunnel excavation work to be carried out in less time than in the past.

With the tunnel excavation method in this exemplary embodiment, the corner-use reaction force receiver 30 is provided at the branching and merging portions from the tunnel T0 to the first tunnel T1, or at the branching and merging portions from the first tunnel T1 to the second tunnel T2.

Consequently, the boring machine 10 can move and excavate smoothly even at the branching and merging portions of the tunnels. This allows the tunnel excavation work to be carried out in less time than in the past.

Other Exemplary Embodiments

An exemplary embodiment of the present invention was described above, but the present invention is not limited to or by the above exemplary embodiment, and various modifications are possible without departing from the gist of the present invention.

In the above exemplary embodiment, an example was described in which the cut component 21*d* composed of concrete or the like was provided to the reaction force receiving face 21*b* of the reaction force receiver 21 of the auxiliary tunneling apparatus 20, and the boring machine 10 excavated this cut component 21*d* while excavating the tunnel T2. The present invention is not limited to this, however.

Figure 11:
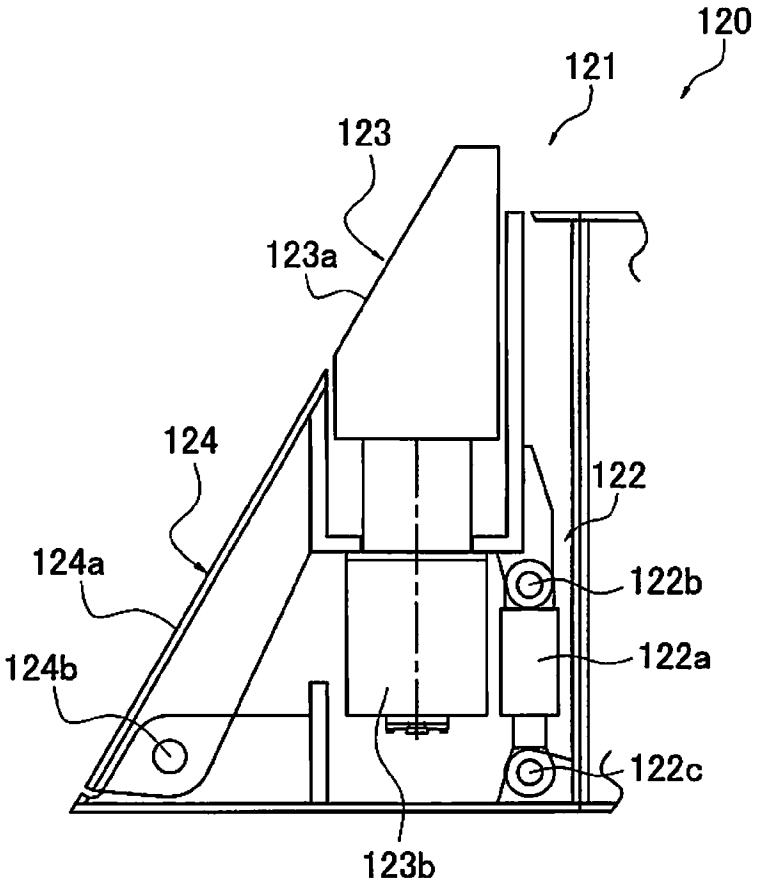
FIG. 11 is a cross section of the internal configuration of the auxiliary tunneling apparatus pertaining to another exemplary embodiment of the present invention.

For example, as shown in FIG. 11, an auxiliary tunneling apparatus 120 may comprise a reaction force receiver 121 equipped with an angle adjustment mechanism 122 that adjusts the angle of the reaction force receiving face formed to match the shape of the side wall of the tunnel T2 being excavated.

More specifically, as shown in FIG. 11, the auxiliary tunneling apparatus 120 comprises the reaction force receiver 121 that has the angle adjustment mechanism 122, a first receiver 123, and a second receiver 124. Just as in first exemplary embodiment, the first and second split components 22 and 23 are linked on the opposite side of the reaction force receiver 121 from the excavation side.

As shown in FIG. 11, the angle adjustment mechanism 122 has a jack 122*a*, a rotation shaft 122*b*, and a rotation shaft 122*c*.

The jack 122*a* expands and contracts to adjust the angle of reaction force receiving faces 123*a* and 124*a* that serve as replacement faces for the side wall T2*a* of the second tunnel T2.

The rotation shafts 122*b* and 122*c* are provided at the two ends of the jack 122*a*, and when the jack 122*a* expands or contracts, the first and second receivers 123 and 124 are rotated to adjust the angle of the reaction force receiving faces 123*a* and 124*a* that serve as replacement faces for the side wall T2*a* of the second tunnel T2.

The first receiver 123 has the force receiving face (replacement face) 123*a* and a jack 123*b*.

The reaction force receiving face 123*a* constitutes part of the replacement face for the side wall T2*a* of the second tunnel T2.

The jack 123*b* is provided to as to be able to move back and forth with respect to the side wall T1*a* of the first tunnel T1 to dispose the reaction force receiving face 123*a* as the replacement face for the side wall T2*a* at the portion where there is no side wall T2*a* of the second tunnel T2, which occurs at the intersection between the first and second tunnels T1 and T2.

When the auxiliary tunneling apparatus 120 is moved through the tunnel, the reaction force receiving face 123*a* can be moved to its retracted position by retracting the jack 123*b*.

The second receiver 124 has a reaction force receiving face (replacement face) 124*a* and a rotation shaft 124*b*.

The reaction force receiving face 124*a* constitutes the replacement face for the side wall T2*a* of the second tunnel T2 along with the reaction force receiving face 123*a* of the first receiver 123.

The rotation shaft 124*b* serves as the rotational center around which the reaction force receiving face 124*a* is rotated when the jack 122*a* of the angle adjustment mechanism 122 is expanded and contracted.

Figure 12B:
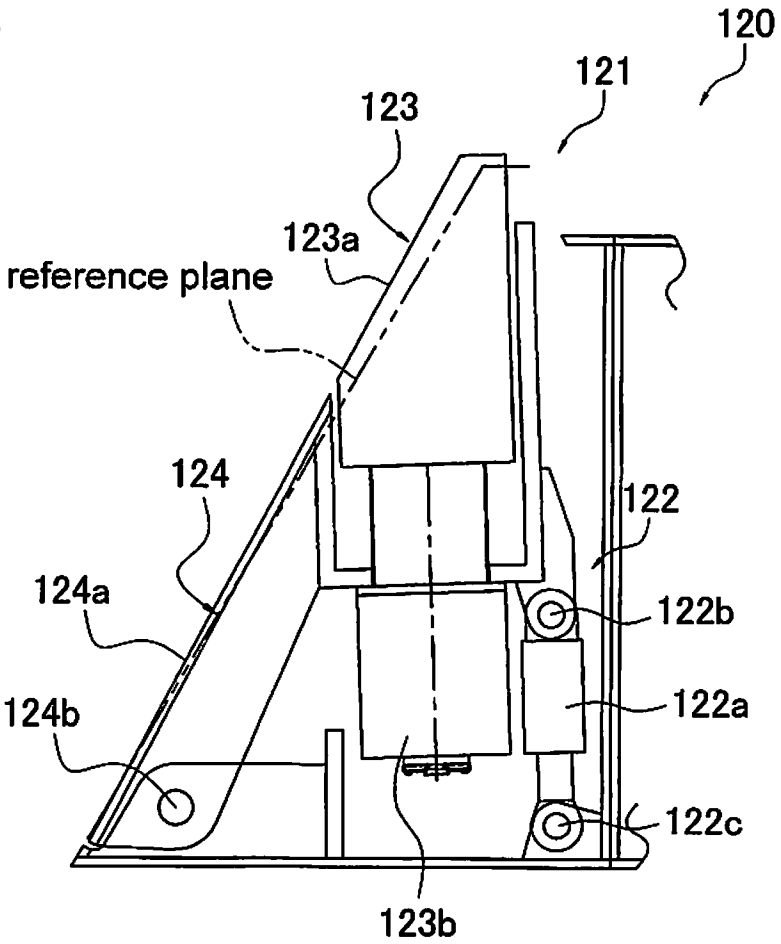
FIGS. 12A and 12B are diagrams illustrating a mechanism for adjusting the angle of the reaction force receiver of the auxiliary tunneling apparatus in FIG. 11.
Figure 12A:
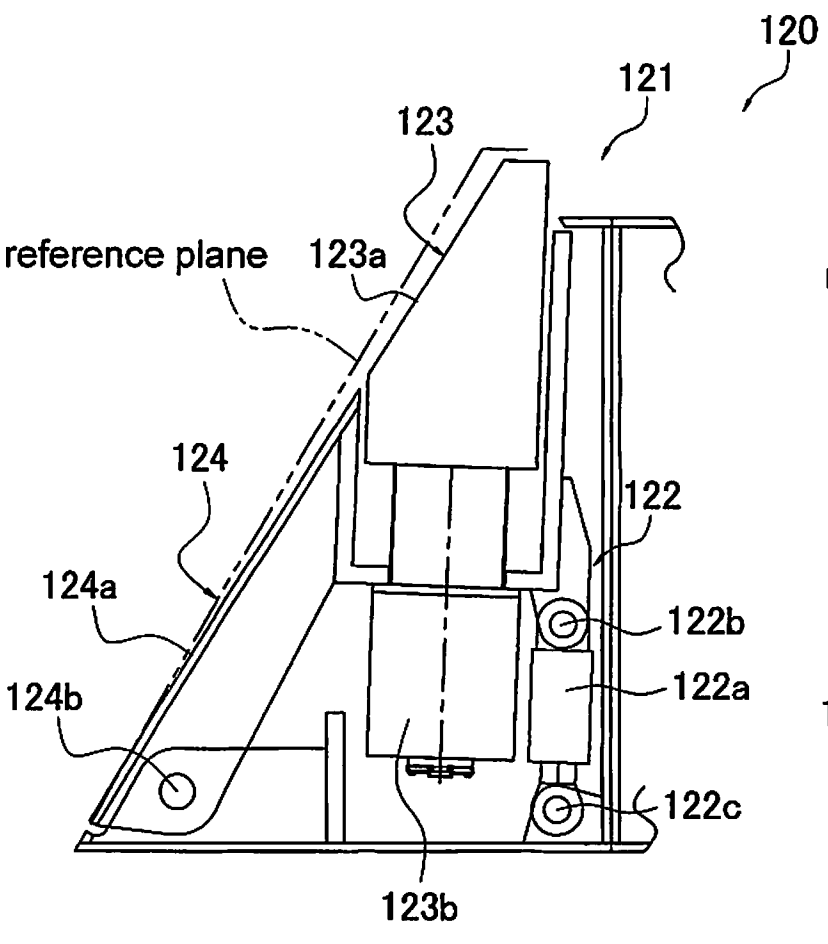

With the auxiliary tunneling apparatus 120 in this exemplary embodiment, as shown in FIG. 12A, the jack 122*a* of the angle adjustment mechanism 122 can be retracted from its initial position to adjust the angle of the reaction force receiving faces 123*a* and 124*a* of the first and second reaction force receiving faces 123 and 124 to a position that is retracted with respect to the reference plane.

As shown in FIG. 12B, meanwhile, the jack 122*a* of the angle adjustment mechanism 122 can be expanded from its initial position to adjust the angle of the reaction force receiving faces 123*a* and 124*a* of the first and second reaction force receiving faces 123 and 124 to a position that protrudes with respect to the reference plane.

Consequently, even when no cut component has been formed by spraying on concrete or the like on the surface of the reaction force receiving faces 123*a* and 124*a*, the angle of the reaction force receiving faces 123*a* and 124*a* can be properly adjusted to match the shape of the side wall T2*a* of the second tunnel T2.

In the above exemplary embodiment, an example was given in which the linking component 23*d* was provided to the second split component 23 of the auxiliary tunneling apparatus 20, and the linking component 23*d* was linked to a tow vehicle, which allows the auxiliary tunneling apparatus 20 to move through the tunnel, but the present invention is not limited to this.

Figure 13:
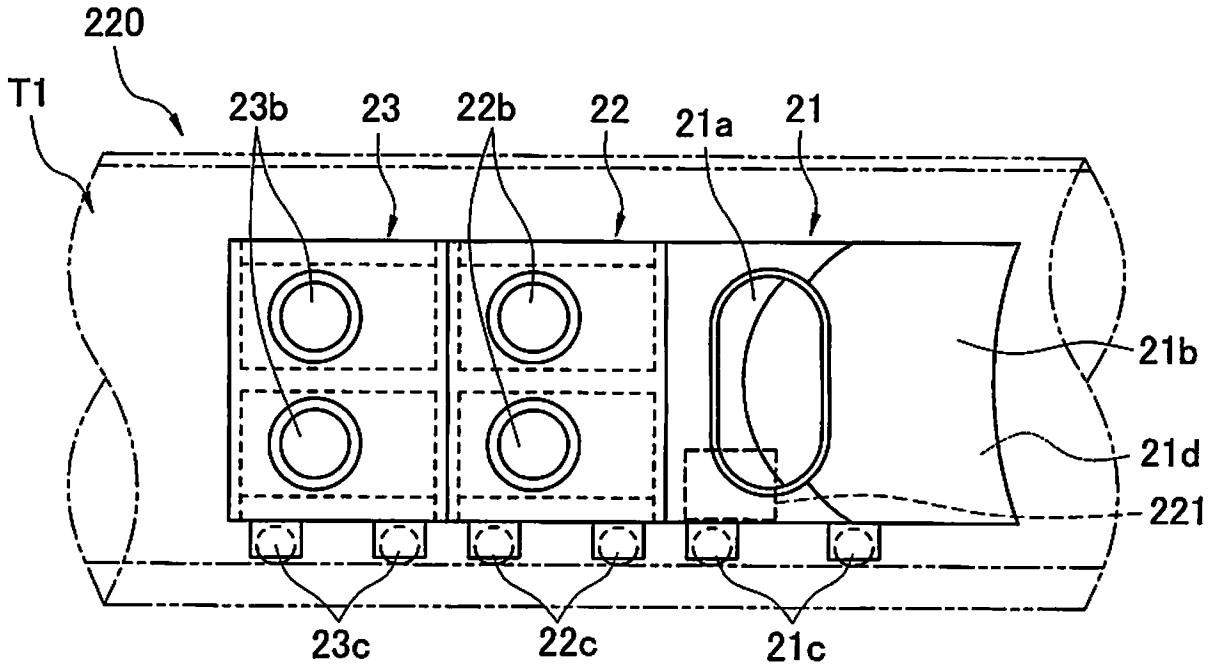
FIG. 13 is a side view of the configuration of the auxiliary tunneling apparatus pertaining to another exemplary embodiment of the present invention.

For example, as shown in FIG. 13, a self-propelled auxiliary tunneling apparatus 220 may have an engine 221 installed in the reaction force receiver 21, so that a rotary drive force is exerted on the travel wheels 21*c*.

Here again, because the auxiliary tunneling apparatus 220 can be moved smoothly, the excavation work in tunnel excavation that includes portions where a plurality of tunnels intersect can be carried out in less time than in the past.

The location where the engine 221 is installed is not limited to the reaction force receiver 21, and may instead be the first and second split components 22 and 23.

The drive source for rotationally driving the travel wheels is not limited to an engine, and may instead be a motor that is driven by a battery, etc.

In the above exemplary embodiment, an example was given of a tunnel excavation method in which second tunnels T2 that intersect three first tunnels T1 are excavated, but the present invention is not limited to this.

For example, the number of existing first tunnels T1 that are excavated prior to the excavation of the second tunnels T2 may be four or more.

Here again, as discussed above, the first and second tunnels T1 and T2 including mutually intersecting portions can be excavated efficiently, so the job will take less time than in the past.

In the above exemplary embodiment, an example was given in which the auxiliary tunneling apparatus 20 had a structure in which the reaction force receiver 21 and the first and second split components 22 and 23 were split in three, but the present invention is not limited to this.

For example, the auxiliary tunneling apparatus may be configured as a unit.

Also, when a split structure is employed, the structure may be one that is split in two, or in four or more parts.

The auxiliary tunneling apparatus of the exemplary embodiments of the present invention has the effect of preventing a decrease in excavation efficiency by a boring machine even when excavating tunnel intersections, and therefore can be widely applied to excavation work in which a tunnel boring machine is used.

The invention claimed is:

1. An auxiliary tunneling apparatus configured to be installed in an excavated first tunnel to assist in excavation of a second tunnel intersecting the first tunnel, the excavation of the second tunnel being done with a boring machine configured to perform excavation of a tunnel by rotating a cutter head in a state in which a gripper pushes against a side wall of the tunnel, the auxiliary tunneling apparatus comprising:

a reaction force receiver configured to be installed in the first tunnel, the reaction force receiver comprising a receiver body and a replacement face at one end of the receiver body, the replacement face being configured to substitute as a part of a side wall of the second tunnel at an intersection where the first and second tunnels intersect each other during the excavation of the second tunnel by the boring machine while the reaction force receiver is installed in the first tunnel, the replacement face being configured for the gripper of the boring machine to push against the replacement face, the replacement face being shaped to curve inward toward the receiver body; and a support component coupled to the receiver body and configured to push against a side wall of the first tunnel and hold the reaction force receiver inside the first tunnel, the support component being configured to be extended and retracted toward and away from the side wall of the first tunnel.

2. The auxiliary tunneling apparatus according to claim 1, further comprising a travel component for moving the auxiliary tunneling apparatus within the first and second tunnels.

3. The auxiliary tunneling apparatus according to claim 2, wherein the travel component has travel wheels rotatably coupled to at least the receiver body and an engine or battery as a drive source for rotating the travel wheels.

4. The auxiliary tunneling apparatus according to claim 2, wherein the travel component includes travel wheels and linking components configured to be linked to a tow vehicle that can travel through the first and second tunnels.

5. The auxiliary tunneling apparatus according to claim 1, wherein the support component is split up into a plurality of parts.

6. The auxiliary tunneling apparatus according to claim 1, wherein the reaction force receiver has a cut component that is provided on at least a portion of the replacement face and can be cut by the boring machine.

7. The auxiliary tunneling apparatus according to claim 1, wherein the reaction force receiver has an angle adjustment mechanism for adjusting an angle of the replacement face.

8. The auxiliary tunneling apparatus according to claim 1, wherein the replacement face has a shape that matches a shape of the side wall of the second tunnel.

9. An auxiliary tunneling apparatus for use in a first tunnel, comprising:

a travel component configured to allow relocation of the auxiliary tunneling apparatus;

a support component having a support jack configured to push on a side wall of the first tunnel and configured to fix the auxiliary tunneling apparatus within the first tunnel; and a reaction force receiver disposed at a first end of the support component in a longitudinal direction of the first tunnel when the reaction force receiver is installed in the first tunnel, the reaction force receiver having a receiver body and a replacement face provided on an opposite side of the receiver body as the side on which the support component is disposed, the replacement face being configured to form a substitute surface corresponding to a portion of a wall surface of a side wall of a second tunnel to be excavated by a boring machine such that the second tunnel intersects the first tunnel, a longitudinal direction of the replacement face extending in a direction that intersects the side wall of the first tunnel when the reaction force receiver is installed in the first tunnel, the replacement face being concave toward the receiver body.

10. The auxiliary tunneling apparatus according to claim 9, wherein the support component is split up into a plurality of parts.

11. The auxiliary tunneling apparatus according to claim 9, wherein the reaction force receiver has a cut component that is provided on at least a portion of the replacement face and can be cut by the boring machine.

12. The auxiliary tunneling apparatus according to claim 9, wherein the reaction force receiver has an angle adjustment mechanism for adjusting an angle of the replacement face.

13. The auxiliary tunneling apparatus according to claim 9, wherein the replacement face has a shape that matches a shape of the side wall of the second tunnel.

14. An auxiliary tunneling apparatus configured to be installed in an excavated first tunnel to assist in excavation of a second tunnel intersecting the first tunnel, the excavation of the second tunnel being done with a boring machine configured to perform excavation of a tunnel by rotating a cutter head in a state in which a gripper pushes against a side wall of the tunnel, the auxiliary tunneling apparatus comprising:

a first reaction force receiver comprising a first receiver body and a first replacement face at one end of the first receiver body, the first replacement face being configured to substitute as a part of a side wall of the second tunnel at an intersection where the first and second tunnels intersect each other during the excavation of the second tunnel by the boring machine, the first replacement face being configured for the gripper of the boring machine to push against the replacement face, the first replacement face having a concave shape that is recessed toward the first receiver body; and a first split component separate from the reaction force receiver and comprising a first body and a first support jack provided on the first body, the first split component being configured to be arranged inside the first tunnel on a side of the first reaction force receiver opposite the end on which the first replacement face is provided in order to support the first reaction force receiver inside the first tunnel, the first support jack being configured to push against a side wall of the first tunnel and hold the first reaction force receiver inside the first tunnel, the first support jack being configured to be extended toward and retracted from the side wall of the first tunnel.

15. The auxiliary tunneling apparatus recited in claim 14, wherein the first split component is configured to be linked to the first reaction force receiver to support the first reaction force receiver inside the first tunnel.

16. The auxiliary tunneling apparatus recited in claim 14, wherein the first split component is configured to contact the first reaction force receiver to support the first reaction force receiver inside the first tunnel.

17. The auxiliary tunneling apparatus recited in claim 14, wherein each of the first reaction force receiver and the first split component is provided with travel wheels for moving the auxiliary tunneling apparatus within the first and second tunnels.

18. The auxiliary tunneling apparatus recited in claim 14, further comprising a second split component separate from the first split component and comprising a second body and a second support jack provided on the second body, the second split component being configured to be arranged inside the first tunnel on a side of the first split component opposite the side on which the first reaction force receiver is disposed in order to support the first split component inside the first tunnel, the second support jack being configured to push against a side wall of the first tunnel, the second support jack being configured to be extended toward and retracted from the side wall of the first tunnel.

19. The auxiliary tunneling apparatus recited in claim 18, wherein the second split component is configured to be linked to the first split component to support the first reaction force receiver inside the first tunnel.

20. The auxiliary tunneling apparatus recited in claim 18, wherein each of the first reaction force receiver, the first split component, and the second split component is provided with travel wheels for moving the auxiliary tunneling apparatus within the first and second tunnels.

21. The auxiliary tunneling apparatus recited in claim 14, further comprising a second reaction force receiver comprising a second receiver body and a second replacement face at one end of the second receiver body, the second replacement face being configured to substitute as another part of a side wall of the second tunnel on an opposite side of the intersection as the first replacement face, the second replacement face having a concave shaped that is recessed toward the second receiver body.

* * * * *